US005817216A

United States Patent [19]

Tomita et al.

[11] Patent Number: 5,817,216

[45] Date of Patent: Oct. 6, 1998

[54] METHOD OF PRODUCING WET FRICTIONAL MATERIAL

[75] Inventors: Minoru Tomita; Tomoaki Sato, both of Shizuoka, Japan

[73] Assignee: NSK-Warner Kabushiki Kaisha, Tokyo, Japan

[21] Appl. No.: 660,126

[22] Filed: Jun. 7, 1996

[30] Foreign Application Priority Data

Jun. 9, 1995 [JP] Japan ..... 7-167063

[51] Int. Cl.[6] ..... D21G 7/00

[52] U.S. Cl. ..... 162/389; 162/218; 162/387

[58] Field of Search ..... 162/218, 380, 162/59, 57, 226, 227, 228, 389, 387; 264/86, 87

[56] References Cited

U.S. PATENT DOCUMENTS

| | | | |
|---|---|---|---|
| 1,838,904 | 12/1931 | Chaplin | 162/219 |
| 1,984,018 | 12/1934 | Hawley | 162/383 |
| 2,797,624 | 7/1957 | Stewart | 162/218 |
| 3,216,889 | 11/1965 | Brafford | 162/218 |
| 3,793,138 | 2/1974 | Rohrer | 162/389 |
| 3,922,191 | 11/1975 | Witt | 162/383 |
| 4,014,737 | 3/1977 | Brennan | 162/226 |

FOREIGN PATENT DOCUMENTS

| | | | |
|---|---|---|---|
| 47-726 | 4/1972 | Japan | 162/388 |

*Primary Examiner*—Brenda A. Lamb
*Attorney, Agent, or Firm*—Sughrue, Mion, Zinn, Macpeak & Seas, PLLC

[57] ABSTRACT

In a method of producing a wet frictional material according to the present invention, paper-making stock solution is circulated and stirred between a paper-making tank and a raw-material tank so that the concentration of the paper-making stock solution is kept constant. A paper-making jig and an up/down suction portion are connected to each other and elevated up and lowered down in the paper-making tank so that water is sucked from the stock solution by a suction apparatus in the period of elevating-up and lowering-down to perform paper-making. The paper-making jig and the up/down suction portion may be formed separately so as to be connected to each other. In this case, the method can cope with requirements of products of various sizes.

7 Claims, 3 Drawing Sheets

DRAINING AND DEHYDRATING

METHOD OF PRODUCING WET FRICTIONAL MATERIAL

BACKGROUND OF THE INVENTION

1. Field of the Invention

The present invention relates to a method of producing a wet frictional material.

2. Description of the Related Art

Conventionally, in order to form a hollow ring-shaped (so-called doughnut-shaped) wet frictional plate, a sheet wet frictional material obtained by paper-making is cut to have a ring shape in use. Accordingly, the center portion of the wet frictional material and the outside of the outer circumference of the wet frictional material are all made scrap, so that the yield rate is no more than 25%.

Therefore, various methods for directly shaping a frictional material like a hollow ring near to the shape of a final product have been proposed. Arranging the proposals theoretically, the methods are briefly classified into a pot method and a bath method which are so called, if differences in specific configuration is neglected.

FIG. 3 is a theoretically explanatory view of the pot method. In FIG. 3, an inner jig 82 is provided to be erected on a filtration plate 84 located in a lower portion of a paper-making tank 81, and a suction portion 86 is provided under the filtration plate 84. A suction pipe 87 is connected to the suction portion 86. The filtration plate 84 has a large number of permeable pores 85, and a ring-shaped net 83 is placed on the filtration plate 84.

If a paper-making stock solution 88 is poured down, as indicated by the arrow F, to a predetermined depth and sucked by a suction apparatus, the solution is drained via the permeable pores 85, the suction portion 86 and the suction pipe 87 as indicated by the arrows R and D, so that paper remains on the net 83. If the top portion of the inner-diameter jig 82 is shaped like a cone as shown in FIG. 3, the stock solution is poured down in all directions so that the paper can be prevented from having directional property.

FIG. 4 is a theoretically explanatory view of the bath method. In FIG. 4, a paper-making stock solution 92 is put into a paper-making tank 91, and a paper-making jig 93 is elevated up and down in the tank as indicated by the arrow R to dehydrate the paper-making stock solution on the circumference of an inner-diameter jig 94 through a net 95 and permeable pores 96 so that paper remains on the net 95. Because not only the paper-making tank can be large-sized but also the jig can be small-sized, the method can cope with requirements of various sizes of products and can be handled easily.

In the pot method in which only an amount of the paper-making stock solution required for paper-making of a single article is supplied and dehydrated, there is no change of the concentration of the paper-making stock solution, so that a paper-quality base material is obtained. However, not only it is necessary to provide a long cylinder as the inner-diameter jig but also the cylinder cannot be moved before completion of the dehydration and paper-making. Accordingly, the jig is large-sized and there is a difficulty in handling the jig. Further, it is difficult to change the size.

In the bath method in which the amount of raw material required for one paper-making cycle is small, the method is unsuitable for obtaining a thick paper-quality base material. Further, because the concentration of raw material in the tank is lowered gradually, it is necessary to control the concentration.

SUMMARY OF THE INVENTION

It is an object of the present invention to provide a method of producing a wet frictional material using small and simple jigs and capable of producing paper-quality base material.

According to the present invention, the method of producing a hollow disk-shaped wet frictional material is comprised of the step of: circulating and stirring a paper-making stock solution containing fiber components and fillers between a paper-making tank and a raw-material tank to keep a concentration of a paper-making stock solution constant; immersing a paper-making jig including a paper-making net portion having a shape of a hollow disk-shaped U-groove into the paper-making stock solution of the paper-making tank; pulling out the paper-making jig from the paper-making stock solution; and while the pulling out step, sucking water from the paper-making stock solution in the paper-making net portion to make paper.

According to the method of the present invention, the stock solution is always circulated and stirred between the raw-material tank and the paper-making tank, so that the concentration of the stock solution can be always kept constant. Further, if the paper-making jig and the up/down suction portion are formed separately, the paper-making jig can be compact-sized and detached. Accordingly, set exchange, or the like, is made easy, so that producing efficiency is improved.

PREFERRED EMBODIMENTS OF THE INVENTION

Referring to the accompanying drawings, preferred embodiments of the present invention will be described as follows.

Figure 1:
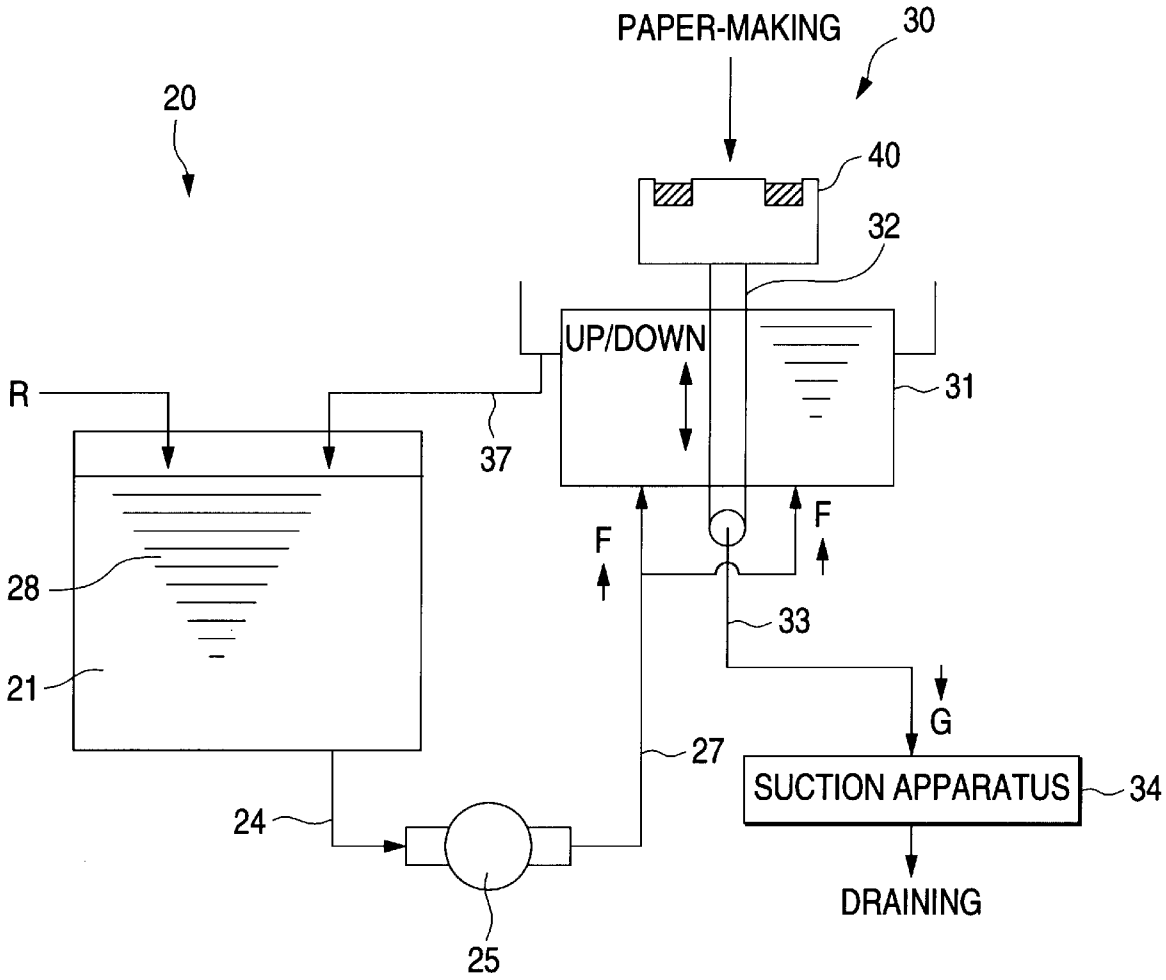
FIG. 1 is an explanatory view of the steps of a first embodiment of the method according to the present invention.
Figure 2:
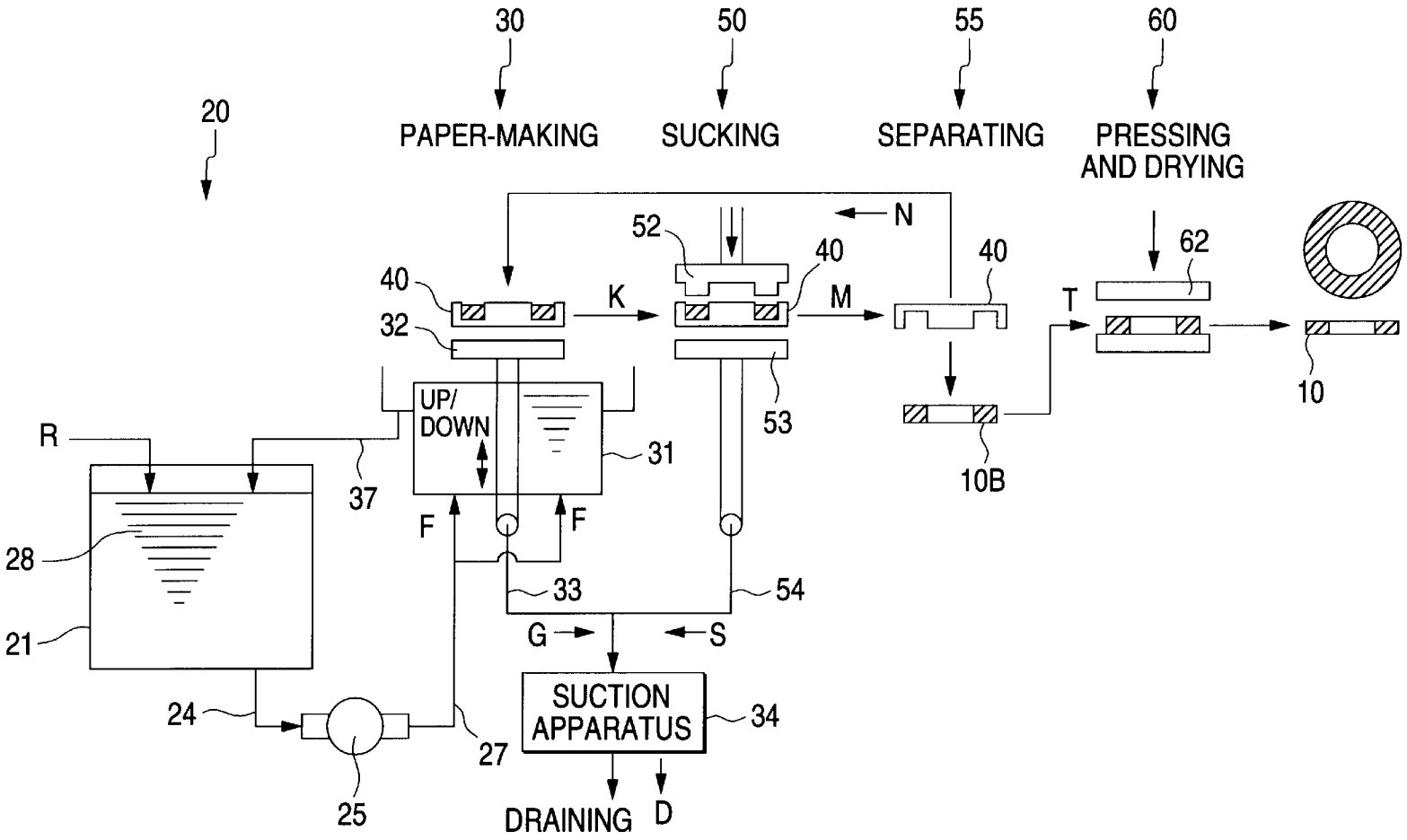
FIG. 2 is also an explanatory view of the steps of a second embodiment.
Figure 3:
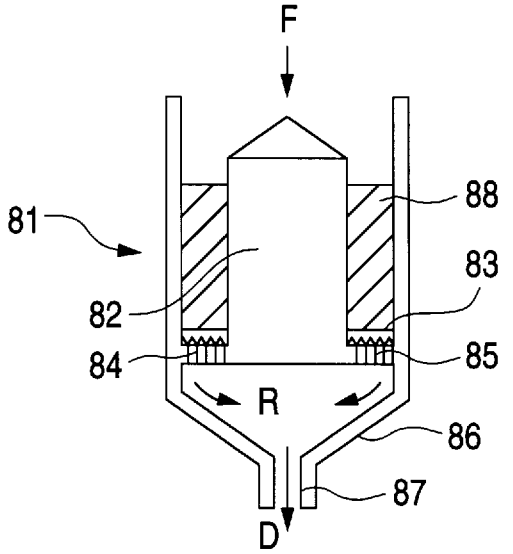
FIG. 3 is an explanatory view of a conventional pot method.
Figure 4:
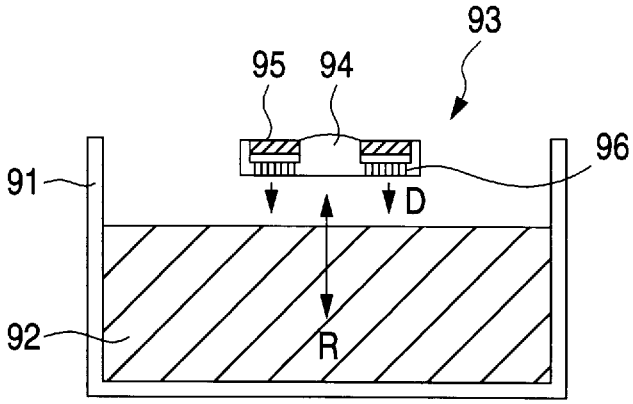
FIG. 4 is an explanatory view of a conventional bath method.

FIG. 1 is a schematic explanatory view of a first embodiment showing the steps of a general method according to the present invention. FIG. 2 is an explanatory view showing a second embodiment of the method according to the present invention in the case where a paper-making jig and an up/down suction portion are provided separately so as to be detachably attached to each other.

Now, the method of the present invention as to the first embodiment with be described with reference to FIG. 1. A raw-material tank portion 20 and a paper-making portion 30 are arranged side by side in rightward order in the drawing. A paper-making stock solution, which is a mixture of raw materials including fiber components, fillers, adjustors, and the like, with water in an stock solution preparation tank (not shown) placed separately, is supplied to a raw-material tank 21 as indicated by the arrow R. The reference numeral 28 designates the stock solution in the tank. The solution is fed from the raw-material tank 21 to a pump 25.

The paper-making stock solution 28 in the raw-material tank 21 is fed to a paper-making tank 31 by means of the circulation pump 25 via a feed pipe 27 as indicated by the arrow F. When the stock solution is fed to the paper-making tank, the stock solution is distributed into several parts as shown in the drawing to accelerate the stirring of the stock solution. Further, a circulation method in which the stock solution which overflowed out of the paper-making tank 31 is returned to the raw-material tank 21 through an overflow pipe 37 is employed to prevent the change of the raw-material mixture ratio due to paper-making. Because the stock solution is fed to the paper-making tank in the distributed state from the raw-material tank, paper-making is performed so that the directional property of fibers contained in the stock solution at the time of paper-making is eliminated to make the distribution uniform in the layers (front, intermediate and rear layers) of a paper-making product uniform.

A paper-making jig 40 which is formed to be integrated with an up/down suction portion 32 is elevated up and lowered down so as to be immersed into and pulled up from the stock solution in the inside of the paper-making tank 31 in the aforementioned condition in which the paper-making stock solution circulates between the raw-material tank 21 and the paper-making tank 31.

In one reciprocating cycle in which the combination body of the paper-making jig 40 and the up/down suction portion 32 is elevated up and lowered down in the paper-making tank so that the paper-making jig 40 is immersed into and pulled up from the stock solution, water is sucked by means of a suction apparatus 34 through the up/down suction portion 32 and a suction pipe 33 as indicated by the arrow G to perform paper-making. Namely, water is sucked while the paper-making jig 40 is not immersed into the stock solution. By changing the stock solution immersing-in and pulling-up rate, and the suction force and suction time of the paper-making jig 40, paper different in basis weight can be obtained even in the case of using the stock solution identical with the mixture ratio.

Upon completion of the paper-making, the thus made paper in the paper-making jig 40 is taken out by a suitable means such as adsorption, or the like, and fed to a dehydrating and drying portion.

FIG. 2 is an explanatory view of the steps of the method of the present invention in a second embodiment in which the paper-making jig 40 and the up/down suction portion 32 are formed separately so as to be detachably attached to each other.

Also in the method shown in FIG. 2, the procedure up to the step of paper-making in the paper-making portion 30 is carried out in the same manner as in FIG. 1.

Upon completion of paper-making in the paper-making jig 40 as described above with reference to FIG. 1, the paper-making jig 40 is separated from the up/down suction portion 32 and fed to a dehydrating portion 50 by means of a loader as indicated by the arrow K. The reference numeral 52 designates a dehydrating pressing plate; 53, a dehydrating suction portion; and 54, a dehydrating suction pipe. These parts are also connected to the suction apparatus 34 so that water obtained by dehydration is sucked by the suction apparatus 34 as indicated by the arrow S. The water is drained from the suction apparatus 34 as indicated by the arrow D.

After dehydration, the paper-making jig 40 is fed to a turning-over/separating portion 55 as indicated by the arrow M. In the turning-over/separating portion 55, the paper-making jig 40 is turned over, so that dehydrated paper 10B obtained by paper-making is separated and taken out. The paper 10B is fed to a drying portion 60 as indicated by the arrow T. In the drying portion 60, the paper 10B is dried to produce finished paper 10. In FIG. 2, the reference numeral 62 designates a drying device such as a hot plate, or the like.

The paper-making jig 40 from which the paper 10B has been separated in the turning-over/separating portion 55 is returned to the paper-making portion 30 as indicated by the arrow N and connected to the up/down suction portion 32 again to perform the next paper-making process.

The method shown in the second embodiment is substantially equivalent to the method shown in the first embodiment. However, the paper-making jig 40 and the up/down suction portion 32 in the second embodiment are formed separately so as to be detachably attached to each other. Accordingly, the paper-making jig 40 can be exchanged to various types of paper-making jigs for paper of various sized so as to be combined with the up/down suction portion. Accordingly, paper size can be changed easily.

Further, because the joint portion between the paper-making jig and the up/down suction portion is formed as a concentric circle, the center of the paper-making jig is always located in a predetermined position even in the case where the paper-making jig 40 is attached to the up/down suction portion 32 in a circumferentially arbitrary position.

According to the method of the present invention, the stock solution is always circulated and stirred between the raw-material tank and the paper-making tank, so that the concentration of the stock solution can be always kept constant. Further, if the paper-making jig and the up/down suction portion are formed separately, the paper-making jig can be compact-sized and detached. Accordingly, set exchange, or the like, is made easy, so that producing efficiency is improved.

What is claimed is:

1. A method of producing a hollow disk-shaped wet frictional material comprising the step of:

circulating and stirring a paper-making stock solution containing fiber components and fillers between a paper-making tank and a raw-material tank to keep a concentration of a paper-making stock solution constant;

immersing a paper-making jig including a paper-making net portion having a shape of a hollow disk-shaped U-groove into the paper-making stock solution of said paper-making tank;

pulling out said paper-making jig from said paper-making stock solution; and while preforming said pulling out step, sucking water from the paper-making stock solution in said paper-making net portion to make paper for use in the wet fictional material.

2. A method of producing a hollow disk-shaped wet frictional material according to claim 1, wherein the circulating and stirring step comprises the steps of:

feeding the paper-making stock solution in said raw-material tank to said paper-making tank to be overflowed from said paper-making tank, and returning the paper-making stock solution overflowed from said paper-making tank to said raw-material tank to keep the concentration of the paper-making stock solution constant.

3. A method of producing a hollow disk-shaped wet frictional material according to claim 1, wherein basis weight of the paper obtained differs by changing at least one of the following conditions:

a time of immersing said paper making jig into the paper-making stock solution in said paper-making tank, a rate of pulling-up of said paper-making jig from the paper-making stock solution in said paper-making tank, a suction force of said paper-making jig, and a suction time of said paper-making jig.

4. A method of producing a hollow disk-shaped wet frictional material according to claim 1, wherein said paper-making jig is integrally formed with an up/down suction portion adaptable for lowering and raising said paper-making jig into and out of the paper-making stock solution.

5. A method of producing a hollow disk-shaped wet frictional material according to claim 1, wherein said paper-making jig and an up/down suction portion, adaptable for lowering and raising said paper-making jig into and out of the paper-making stock solution, are separately formed; and said method further comprises the steps of: after said sucking step, disconnecting said paper-making jig from said up/down suction portion to dehydrate the paper; and pressing the paper formed in said paper-making net portion of the U-groove of said paper making jig to dry and shape the paper.

6. A method as claimed in claim 1, wherein the immersing, pulling out and sucking steps are performed while the circulating and stirring step is being performed.

7. A method as claimed in claim 1, wherein the circulating and stirring step comprises the step of feeding the paper-making stock solution into the paper-making tank to stir and distribute the paper-making stock solution in the paper-making tank.

* * * * *